US008345822B2

(12) United States Patent
Ollinger

(10) Patent No.: US 8,345,822 B2
(45) Date of Patent: Jan. 1, 2013

(54) X-RAY OPTICAL CONFIGURATION WITH TWO FOCUSING ELEMENTS

(75) Inventor: Christoph Ollinger, Karlsruhe (DE)

(73) Assignee: Bruker AXS GmbH, Karlsruhe (DE)

( * ) Notice: Subject to any disclaimer, the term of this patent is extended or adjusted under 35 U.S.C. 154(b) by 213 days.

(21) Appl. No.: 12/926,607

(22) Filed: Nov. 30, 2010

(65) Prior Publication Data

US 2011/0135059 A1 Jun. 9, 2011

(30) Foreign Application Priority Data

Dec. 8, 2009 (DE) ..... 10 2009 047 672

(51) Int. Cl.
*G21K 1/06* (2006.01)

(52) U.S. Cl. ..... 378/85

(58) Field of Classification Search ..... 378/70–85, 378/147

See application file for complete search history.

(56) References Cited

U.S. PATENT DOCUMENTS

| | | | | |
|---|---|---|---|---|
| 6,807,251 | B2 | 10/2004 | Okanda | 378/71 |
| 2003/0043965 | A1 | 3/2003 | Bahr | 378/70 |
| 2008/0084967 | A1 | 4/2008 | Matsuo | 378/149 |

OTHER PUBLICATIONS

BRUKER axs GMBH; Karlsruhe / Germany, "Diffraction Solutions D8 Advance", 2002.

*Primary Examiner* — Courtney Thomas
(74) *Attorney, Agent, or Firm* — Paul Vincent

(57) ABSTRACT

An X-ray optical configuration (1), comprising a position for an X-ray source (2), a position for a sample (3), a first focusing element (4) for directing X-ray radiation from the position of the X-ray source (2) via an intermediate focus (5) onto the position of the sample (3), and an X-ray detector (6) that can be moved on a circular arc (7) of radius R around the position of the sample (3), is characterized in that the configuration also comprises a second focusing element (8) for directing part of the X-ray radiation emanating from the intermediate focus (5) onto the position of the sample (3), and an aperture system (9) for selecting between illumination of the position of the sample (3) exclusively and directly from the intermediate focus (5) (=first optical path (10')), or exclusively via the second focusing element (8) (=second optical path (10")). The configuration facilitates changing between reflection geometry and transmission geometry, in particular, wherein modification and adjustment devices are minimized or unnecessary.

14 Claims, 4 Drawing Sheets

X-RAY OPTICAL CONFIGURATION WITH TWO FOCUSING ELEMENTS

This application claims Paris Convention priority of DE 10 2009 047 672.5 filed Dec. 8, 2009 the complete disclosure of which is hereby incorporated by reference.

BACKGROUND OF THE INVENTION

The invention concerns an X-ray optical configuration, comprising

- a position for an X-ray source,
- a position for a sample,
- a first focusing element for directing X-ray radiation from the position of the X-ray source via an intermediate focus onto the position of the sample, and
- an X-ray detector which can be moved along a circular arc of radius R around the position of the sample.

An X-ray optical configuration of this type is disclosed in U.S. Pat. No. 6,807,251 B2 and in the leaflet Bruker AXS GmbH; Karlsruhe, Germany, "Diffraction Solutions D8 Advance" 2002.

X-ray diffractometry may be used for diverse analytical tasks, in which different measuring geometries are used, e.g. Bragg-Brentano or parallel beam geometry. This requires, however, different X-ray optical elements in the optical path. In order to enable fast change between the various measuring geometries, it is desired to keep the necessary modification measures at a minimum level.

U.S. Pat. No. 6,807,251 B2 discloses an X-ray diffractometer with a parabolic mirror for use of the diffractometer in parallel beam geometry, and a slotted plate with two slots, wherein one of the slots is used to delimit the X-ray beam in the Bragg Brentano geometry. The mirror and the slotted plate are rigidly connected to each other. A rotatable path selection disk with a further slot is disposed behind the aperture/mirror unit and can be rotated to select the X-ray beam (parallel or divergent) that is required for the corresponding geometry.

DE 101 41 958 A1 discloses an X-ray diffractometer, in which the X-ray radiation can be guided in sections on different beam paths for a variety of tasks, wherein one of the beam paths extends in a straight line from the sample through an aperture system with adjustable and/or exchangeable apertures to the X-ray detector, whereas the other beam path is bent, extending initially from the sample position to a dispersive or reflecting X-ray optical element, and from there to the X-ray detector. The bent beam path can be collimated out with respect to the detector by means of the shutter. The aperture and the dispersive or reflecting X-ray optical element are adjusted in a rigid fashion with respect to each other and can be pivoted together with respect to the sample.

Diffractometers are often not only used to measure samples in reflection geometry (such as e.g. powder samples) but also samples in transmission geometry (such as e.g. foils or capillaries). Towards this end, the X-ray optical configuration of conventional X-ray diffractometers must be manually modified as is schematically indicated e.g. in the mentioned leaflet of Bruker AXS GmbH on page 13 and 14, respectively.

The modification of X-ray optical elements turns out to be disadvantageous in practice, since the modified X-ray optical elements must be readjusted each time. This is an extremely time-consuming process which must also be performed by qualified staff.

Moreover, some of the X-ray optical components, such as e.g. focusing crystals or holders, must be exchanged in most cases, which requires careful storage of the currently not required X-ray optical components. The expensive X-ray optical components are therefore subjected to an increased risk of being damaged or even getting lost during modification and storage.

In contrast thereto, it is the underlying purpose of the present invention to propose an X-ray optical configuration which facilitates change between reflection geometry and transmission geometry, in particular, in which modification and adjustment works are minimized or superfluous.

SUMMARY OF THE INVENTION

This object is achieved in accordance with the invention in a surprisingly simple and also effective fashion by an X-ray optical configuration of the above-mentioned type, which is characterized in that the configuration also comprises:

- a second focusing element for directing part of the X-ray radiation emanating from the intermediate focus onto the position of the sample, and
- an aperture system for selecting between illumination of the position of the sample
- exclusively and directly from the intermediate focus (=first optical path) or
- exclusively via the second focusing element (=second optical path).

The second focusing element splits the X-ray radiation emanating from the intermediate focus into two optical paths. The aperture system enables selection of the optical path that is required for illuminating the position of the sample for the respective measuring method. The optical path that is not required is thereby blocked by the aperture system.

Switching over between transmission geometry and reflection geometry is thereby facilitated and no time-consuming modifications are required. Switching over is furthermore sufficiently simple that qualified staff are not required.

In one preferred embodiment of an inventive X-ray optical configuration, the separation between the position of the sample and the intermediate focus corresponds to the radius R of the circular arc. In this embodiment, the first optical path is highly suitable for reflection measurements. The X-ray radiation has already been well focused on the detector, resulting in good intensity and measurement resolution.

In another embodiment of an inventive X-ray optical configuration, a focus aperture is disposed in the optical path of the X-ray radiation, which has a separation from the position of the sample which corresponds to the radius R of the circular arc. The focus aperture is thereby disposed between the first focusing element and the sample position. This embodiment is mainly used when the intermediate focus is not on the circular arc extending at a radius R around the position of the sample but e.g. further away from the sample position. The focus aperture improves the intensity and the measurement resolution for reflection measurements, in particular, for the first optical path.

In a further development of these embodiments, the X-ray radiation directly emanating from the intermediate focus or having passed the focus aperture is reflected by the sample, and is focused onto the circular arc. This enables reflection measurements on the sample.

In a preferred embodiment of an inventive X-ray optical configuration, the X-ray radiation emanating from the second focusing element is focused onto the circular arc through the position of the sample. This enables transmission measurements with a permeable sample, such as e.g. polymer foils. In an alternative fashion, the sample can be optimally illuminated with the X-ray radiation emanating from the second focusing element.

In another preferred embodiment of the inventive X-ray optical configuration, the circular arc on which the detector can be moved subtends an angle of at least 50°, advantageously at least 100°, and preferentially at least 140°. Normal measuring tasks in the pharmaceutical field can be covered by a region of 50° that can be swept by a detector. Larger angular ranges provide even greater universal use of the X-ray optical configuration.

In one particularly preferred embodiment of an inventive X-ray optical configuration, the first and/or second focusing element is/are formed as Johansson monochromator or multilayer gradient mirror (Goebel mirror). These kinds type of monochromators or X-ray mirrors have proven to be advantageous in practice.

One embodiment of the inventive X-ray optical configuration is particularly preferred, which comprises a motor for switching over between the first optical path and the second optical path. The motor moves at least part of the aperture system. The two optical paths normally have associated end stops. Motorization simplifies the switching over process. The motor may also be operated under computer control. The aperture system may alternatively also be switched over manually.

In one further advantageous embodiment of an inventive X-ray optical configuration, the aperture width of the aperture system is variable for at least one of the two optical paths. In this fashion, the X-ray beam can be adjusted to the requirements of a specific experiment, in particular, with respect to the overall intensity.

In one particularly preferred embodiment of the invention, one separate device for collimating the X-ray radiation is provided for each of the two optical paths. In this fashion, each of the optical paths can be collimated irrespectively of the other. Such a configuration is also relatively easy to realize, and switching over of the optical paths is easy.

In one further preferred embodiment of an inventive X-ray optical configuration, one separate fixed aperture is provided for each of the two optical paths. This is also a configuration that is easy to realize. When the optical paths are switched over, the respective apertures are always in the correct position.

In one particularly preferred embodiment of an inventive X-ray optical configuration, the aperture system has a slotted aperture block which can be rotated about an axis extending perpendicularly with respect to the circular arc plane, the body of the aperture block blocking the second optical path in a first rotary position, wherein the first optical path extends in the area of the slot of the aperture block, and in a second rotary position of the aperture block, the first optical path is blocked by the body of the aperture block, wherein the second optical path extends past the body of the aperture block. An aperture block of this type enables fast switching over between the two optical paths. No further movable parts are required. Rotation of the aperture block may be realized within a small space. The aperture block additionally acts as an aperture for the first optical path. In a suitable design, the aperture width may also be adjusted through variation of the angle of rotation. The block may also be rotated by a motor with simple constructional means.

In an alternative embodiment of the invention, the aperture system comprises a slotted aperture which can be displaced between two sliding positions. One of the optical paths is thereby blocked by the body of the aperture in each of the two sliding positions and the respective other optical path extends in the area of the slot of the aperture. In this embodiment, switching over between the optical paths can be realized through simple displacement of the slotted aperture.

Further advantages of the invention can be extracted from the description and the drawing. The features mentioned above and below may be used individually or collectively in arbitrary combination. The embodiments shown and described are not to be understood as exhaustive enumeration but have exemplary character for describing the invention.

DESCRIPTION OF THE PREFERRED EMBODIMENT

Figure 1:
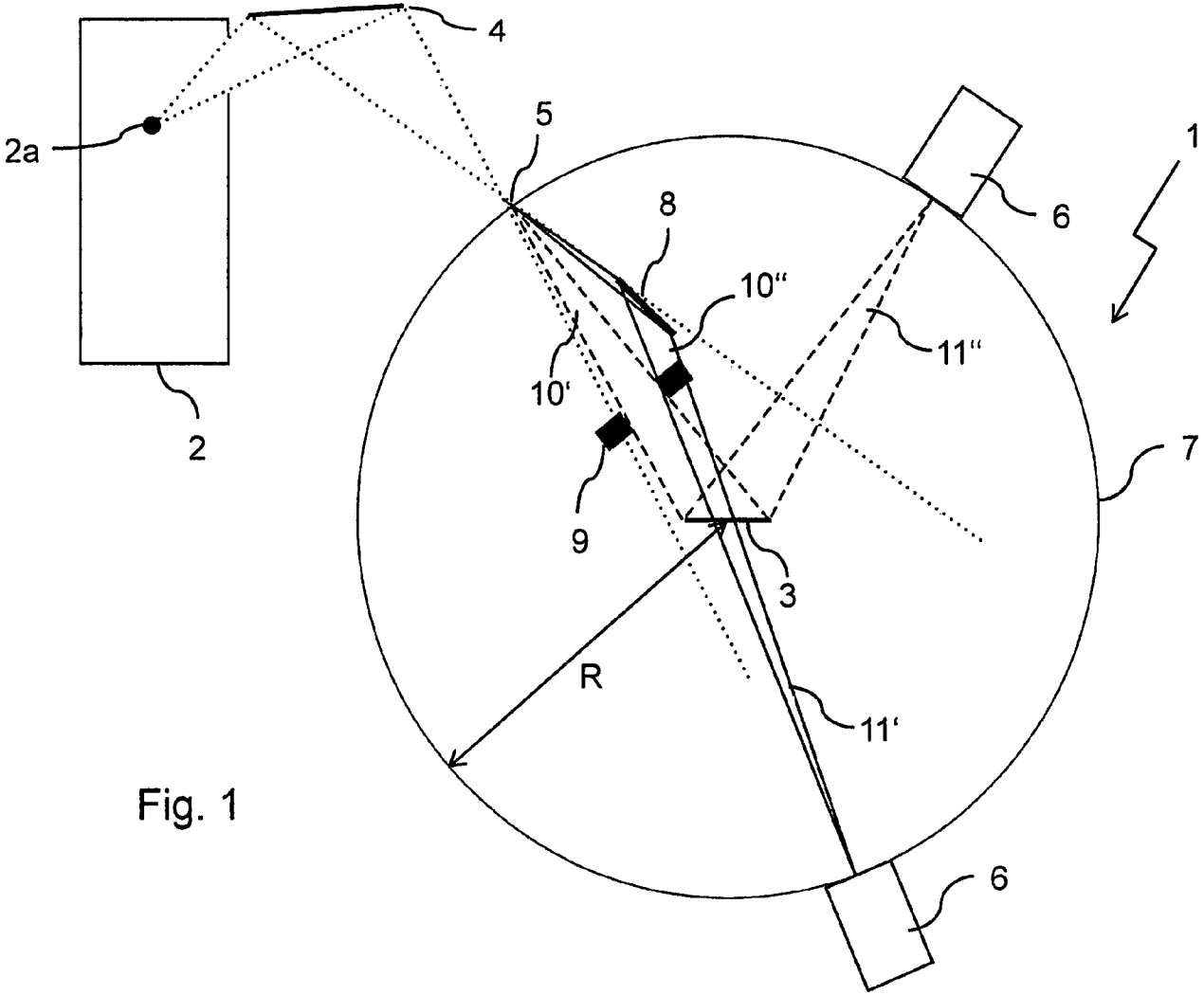
FIG. 1 shows a schematic view of an inventive X-ray optical configuration.

FIG. 1 schematically shows an inventive X-ray optical configuration 1. X-ray radiation is emitted by an X-ray source 2 with a source focus 2*a*, and is incident on a first focusing element 4 which initially focuses the X-ray radiation onto an intermediate focus 5. It is preferably positioned on a circular arc 7 with a radius R, on which a detector 6 is also movably disposed.

Part of the X-ray radiation emanating from the intermediate focus 5 is directly incident, in the form of a first optical path 10', on the position of the sample 3 where it is reflected by the sample and focused onto the circular arc 7.

Another part of the X-ray radiation emanating from the intermediate focus 5 is initially incident on a second focusing element 8 and is focused from there in the form of a second optical path 10" through the position of the sample 3 onto the circular arc 7.

A switchable aperture system 9 thereby shades one of the two optical paths 10' or 10" depending on the measuring method. By way of example, shading by the aperture system 9 in FIG. 1 is selected such that the second optical path 10" is shaded to prevent transmission 11" through the sample.

Figure 2:
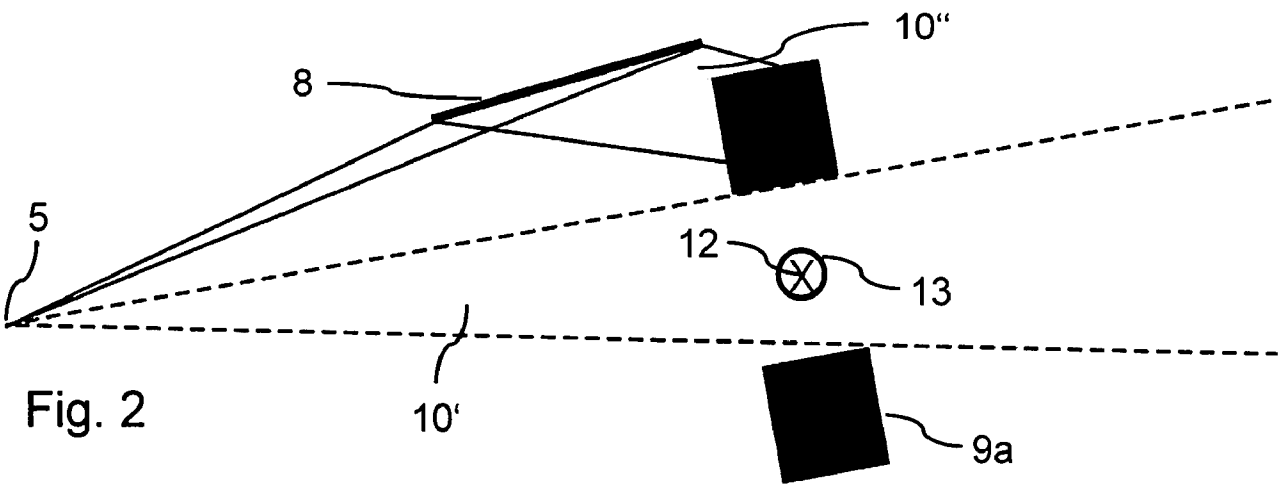
FIG. 2 shows a schematic view of a rotatable, slotted aperture block for an inventive X-ray optical configuration in a first rotary position.

FIG. 2 schematically shows a rotatable slotted aperture block 9*a* as an embodiment of the aperture system 9. The aperture block 9*a* is thereby in a first rotary position with respect to an axis of rotation 12, in which position the X-ray radiation directly emanating from the intermediate focus 5 extends in the area of the slot of the aperture block 9*a*. It should be noted that the effective aperture width can be varied to a certain extent through rotation of the aperture block. The part of the X-ray radiation that is initially incident on the second focusing element 8 is thereby shaded by the body of the aperture block 9*a*. Only the X-ray radiation that follows the first optical path 10' reaches the position of the sample 3 (not shown herein).

Figure 3:
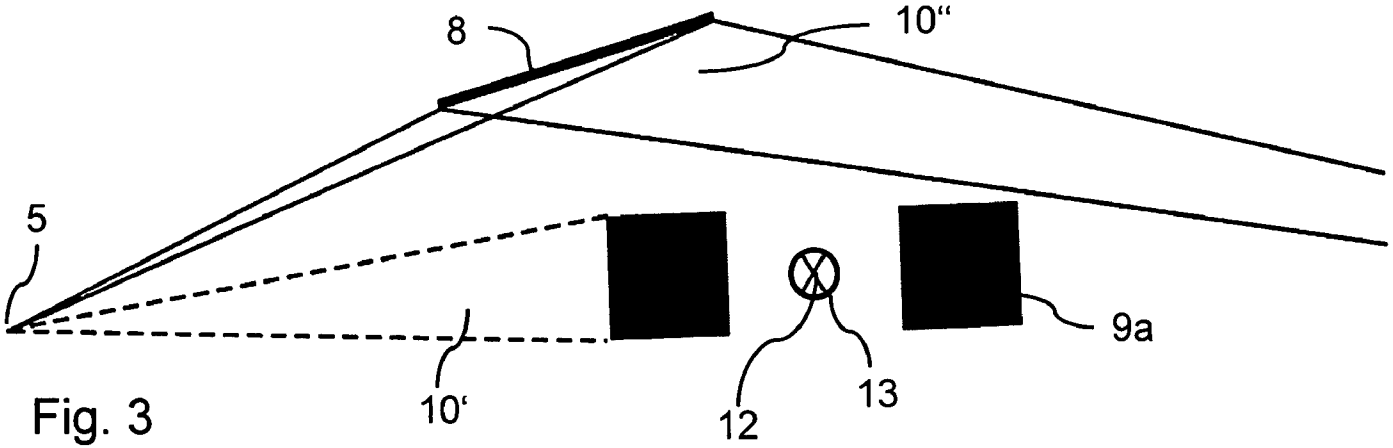
FIG. 3 shows a schematic view of the slotted aperture block of FIG. 2 in the second rotary position.

FIG. 3 schematically shows the second rotary position of the rotatable slotted aperture block 9*a*. The aperture block 9*a* is thereby pivoted about the axis of rotation 12 compared to FIG. 2. The pivoting motion is realized by a motor 13. The body of the aperture block 9*a* thereby shades the optical path 10' of the X-ray radiation directly emanating from the intermediate focus 5. The X-ray radiation extending via the second focusing element 8 can pass by the body of the aperture block 9*a* to the position of the sample 3 (not shown herein).

Figure 4:
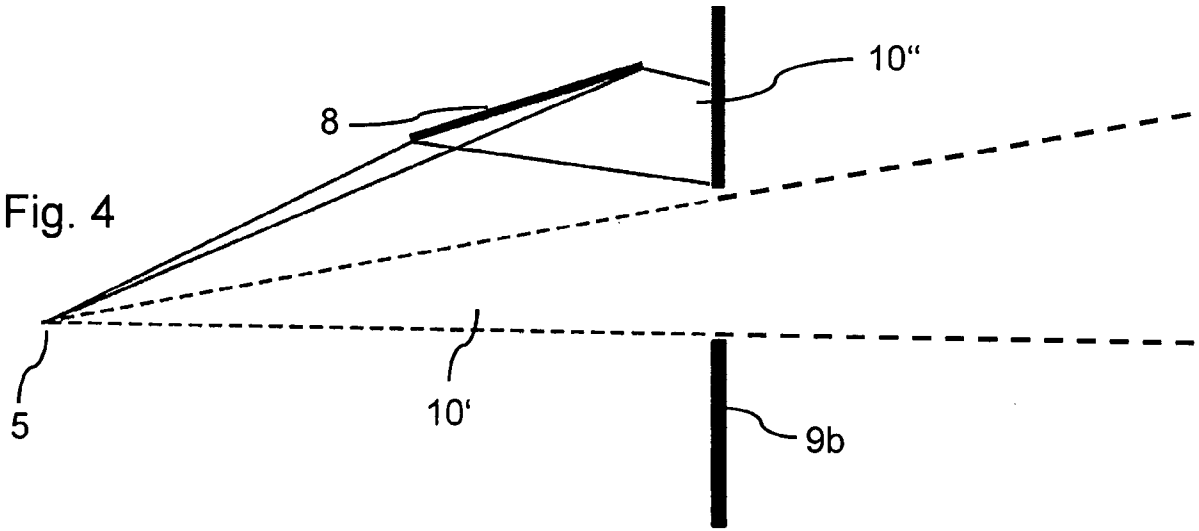
FIG. 4 shows a schematic view of a displaceable slotted aperture for an inventive X-ray optical configuration in a first sliding position.

FIG. 4 schematically shows an alternative embodiment of the aperture system 9. The aperture system is thereby designed in the form of a displaceable slotted aperture 9*b*. In the first sliding position of FIG. 4, the X-ray radiation directly emanating from the intermediate focus 5 extends in the area of the slot of the aperture 9*b*. The part of the X-ray radiation that is initially incident on the second focusing element 8 is thereby shaded by the body of the aperture 9*b*.

Figure 5:
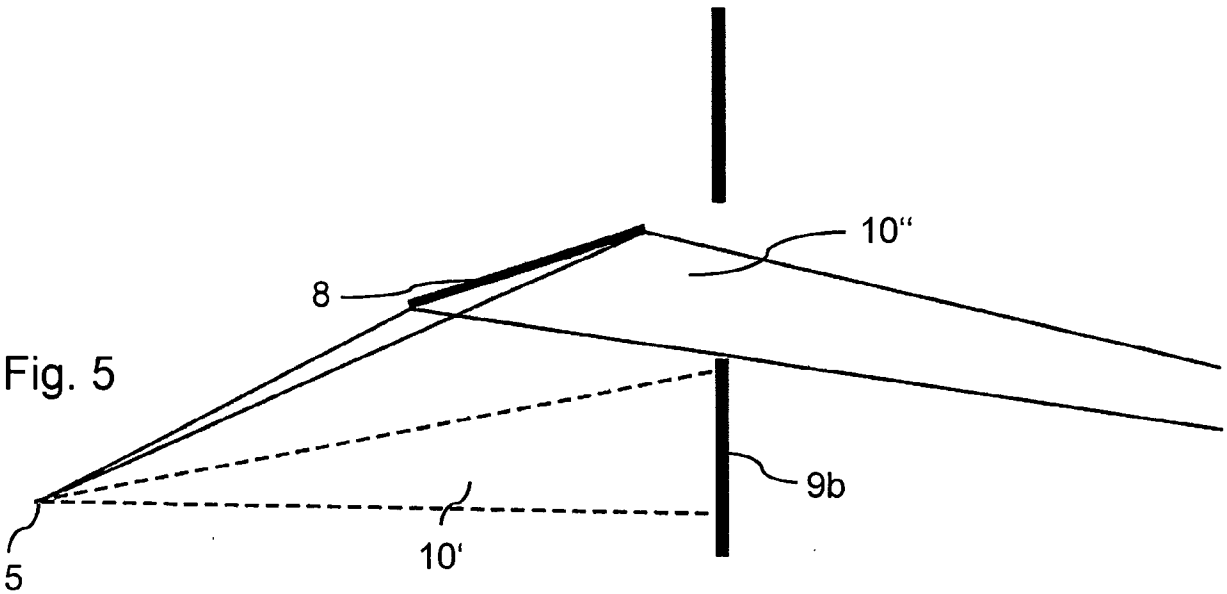
FIG. 5 shows a schematic view of the displaceable slotted aperture block of FIG. 4 in a second sliding position.

In a second sliding position which is schematically illustrated in FIG. 5, the body of the aperture 9*b* then shades the optical path 10' of the X-ray radiation directly emanating from the intermediate focus 5. The part of the X-ray radiation that is initially incident on the second focusing element 8, i.e. is associated with the second optical path 10", extends in the area of the slot of the aperture 9*b* in this sliding position.

Figure 6:
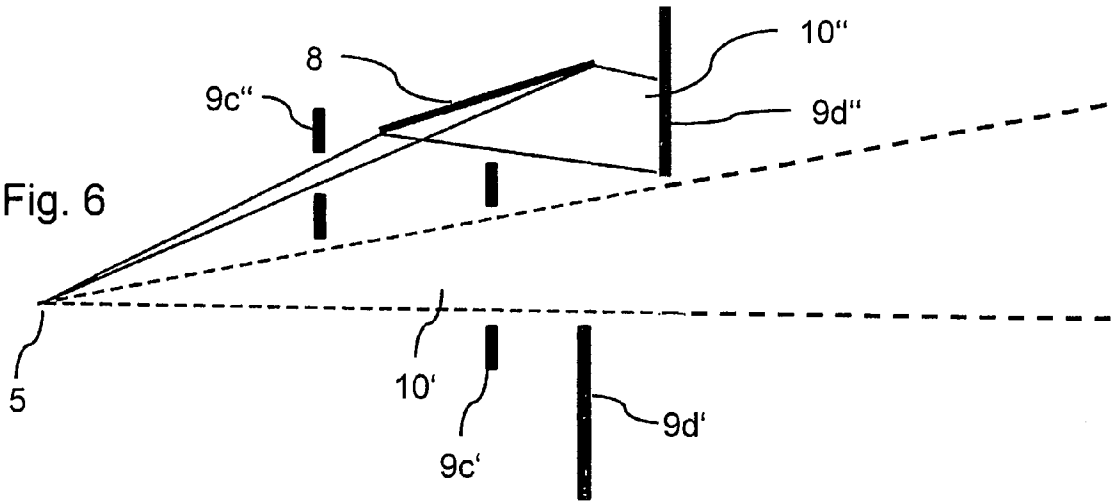
FIG. 6 shows a schematic view of an aperture system consisting of one aperture and one device for shading for each optical path, for an inventive X-ray optical configuration.

FIG. 6 shows a further embodiment. In this case, each of the two optical paths 10', 10" has a fixed aperture 9*c*', 9*c*" and a shading device 9*d*', 9*d*". In the setting of FIG. 6, the first optical path 10' initially extends from the intermediate focus 5 through the aperture 9*c*' and then past the open shading device 9*d*' towards the position of the sample 3 (not shown). The second optical path 10" initially extends from the intermediate focus 5 through the aperture 9*c*", is then incident on the second focusing element 8 and is then shaded by the shading device 9*d*".

Figure 7:
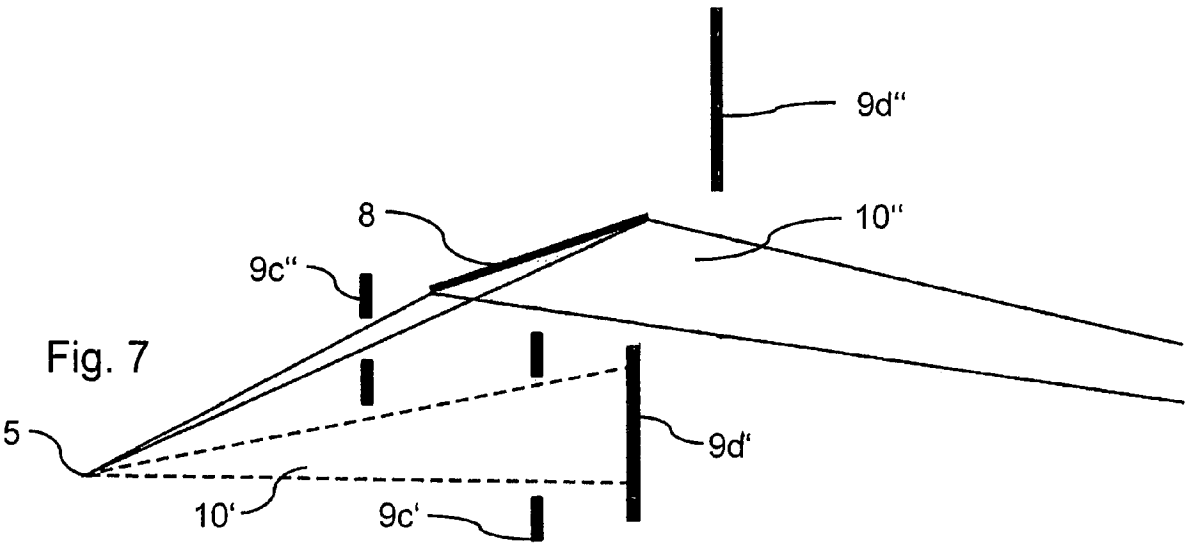
FIG. 7 is like FIG. 6, the shading devices, however, having another setting.

FIG. 7 shows the embodiment of FIG. 6 with inversely switched shading devices 9*d*' and 9*d*". The first optical path 10' thereby extends from the intermediate focus 5 through the aperture 9*c*' and is shaded by the shading device 9*d*'. The second optical path 10" extends from the intermediate focus 5 through the aperture 9*c*", is then incident on the second focusing element 8 and then extends past the shading device 9*d*" towards the position of the sample 3 (not shown). In addition to the operational positions shown in FIGS. 6 and 7, both shading devices 9*d*', 9*d*" may e.g. block the respective optical path 10', 10".

LIST OF REFERENCE NUMERALS

1 X-ray optical configuration
2 X-ray source
2*a* source focus
3 position of the sample
4 first focusing element
5 intermediate focus
6 X-ray detector
7 circular arc with radius R
8 second focusing element
9 aperture system
9*a* rotatable slotted aperture block
9*b* displaceable slotted aperture
9*c*' fixed aperture for the first optical path
9*c*" fixed aperture for the second optical path
9*d*' shading device for the first optical path
9*d*" shading device for the second optical path
10' first optical path
10" second optical path
11' reflection by the sample
11" transmission through the sample
12 axis of rotation of the rotatable slotted aperture block
13 motor

I claim:

1. An X-ray optical configuration for use together with an X-ray source and a sample, the optical configuration comprising:

a first focusing element for directing, via an intermediate focus, X-ray radiation from the X-ray source onto the sample;

an X-ray detector, said detector structured for motion along a circular arc of radius R around the sample;

a second focusing element for directing part of the X-ray radiation emanating from said intermediate focus onto the sample; and an aperture system, said aperture system having a first position in which the sample is exclusively and directly illuminated from said intermediate focus along a first optical path and a second position in which the sample is exclusively illuminated via said second focusing element along a second optical path.

2. The X-ray optical configuration of claim 1, wherein a separation between the sample and said intermediate focus corresponds to said radius R of said circular arc.

3. The X-ray optical configuration of claim 1, further comprising a focus aperture disposed in an optical path of the X-ray radiation and having a separation from the sample which corresponds to said radius R of said circular arc.

4. The X-ray optical configuration of claim 2, wherein the X-ray radiation directly emanating from said intermediate focus or having passed said focus aperture is reflected by the sample and focused onto said circular arc.

5. The X-ray optical configuration of claim 3, wherein the X-ray radiation directly emanating from said intermediate focus or having passed said focus aperture is reflected by the sample and focused onto said circular arc.

6. The X-ray optical configuration of claim 1, wherein the X-ray radiation emanating from said second focusing element is focused through the sample onto said circular arc.

7. The X-ray optical configuration of claim 1, wherein said circular arc on which said detector can be moved, subtends an angle of at least 50°, at least 100° or at least 140°.

8. The X-ray optical configuration of claim 1, wherein said first and/or said second focusing element is designed as a Johansson monochromator or a Goebel mirror.

9. The X-ray optical configuration of claim 1, further comprising a motor for switching over between said first optical path and said second optical path.

10. The X-ray optical configuration of claim 1, wherein an aperture width of said aperture system is variable for at least one of said first and said second optical paths.

11. The X-ray optical configuration of claim 1, wherein each of said first and said second optical paths has a dedicated device for shading the X-ray radiation.

12. The X-ray optical configuration of claim 1, wherein each of said first and said second optical paths has a dedicated fixed aperture.

13. The X-ray optical configuration of claim 1, wherein said aperture system comprises a slotted aperture block which can be rotated about an axis that extends perpendicularly with respect to a plane of said circular arc, said second optical path being blocked by a body of said aperture block in a first rotary position, wherein said first optical path extends in an area of a slot of said aperture block and, in a second rotary position, said first optical path is blocked by said body of said aperture block, wherein said second optical path extends past said body of said aperture block.

14. The X-ray optical configuration of claim 1, wherein said aperture system comprises a slotted aperture, said aperture structured to move between two sliding positions, one of said first and said second optical paths being blocked by a body of said aperture in each of said two sliding positions, wherein a respective other optical path extends in an area of a slot of said aperture.

* * * * *